US006422445B2

(12) United States Patent
Nilsson et al.

(10) Patent No.: US 6,422,445 B2
(45) Date of Patent: Jul. 23, 2002

(54) METHOD AND DEVICE FOR FEEDING OF LONG OBJECTS

(76) Inventors: Rune Nilsson, Hyggesvägen 14, S334 32 Anderstorp (SE); Roine Nilsson, Hagvägen 24, S-334 32 Anderstorp (SE)

( * ) Notice: Subject to any disclaimer, the term of this patent is extended or adjusted under 35 U.S.C. 154(b) by 0 days.

(21) Appl. No.: 09/789,812

(22) Filed: Feb. 22, 2001

Related U.S. Application Data

(63) Continuation of application No. PCT/SE99/01540, filed on Sep. 3, 1999.

(30) Foreign Application Priority Data

Sep. 8, 1998 (SE) ..... 9803044

(51) Int. Cl.[7] ..... B23Q 15/00; B65H 20/00; B21D 43/00

(52) U.S. Cl. ..... 226/43; 226/156; 72/405.01; 72/419

(58) Field of Search ..... 226/43, 32, 156; 72/405.01, 419

(56) References Cited

U.S. PATENT DOCUMENTS 3,762,198 A * 10/1973 Bair ..... 72/28.2
3,817,067 A * 6/1974 Voorehes et al. ..... 72/11.4
4,078,416 A * 3/1978 Voorhees et al. ..... 72/419
4,134,334 A * 1/1979 Johson ..... 100/48
4,553,445 A 11/1985 Holbrook et al.
4,561,581 A * 12/1985 Kelly ..... 226/113
4,707,988 A * 11/1987 Palmers ..... 60/413
4,953,808 A * 9/1990 Craycraft ..... 72/419 X
5,079,489 A * 1/1992 Ishii ..... 72/405.01
5,224,053 A * 6/1993 Cook ..... 72/405.01
5,392,977 A * 2/1995 Kato ..... 226/42
5,456,098 A * 10/1995 Hartwig et al. ..... 72/419 X
5,833,105 A * 11/1998 Stuber ..... 226/43 X

* cited by examiner

*Primary Examiner*—Michael R. Mansen
(74) *Attorney, Agent, or Firm*—Pillsbury Winthrop LLP

(57) ABSTRACT

A method and apparatus for feeding of strip material to a working machine in which the material is worked upon and separated into individual parts includes intermittent feeding of the strip material to working machines wherein the feed rate is controlled in relation to the speed of the working machine. The control of the feed rate is by a control system having a processor that is supplied with signals which correspond to the speed and position of the working machine and the feed rate and fed length of the material.

18 Claims, 1 Drawing Sheet

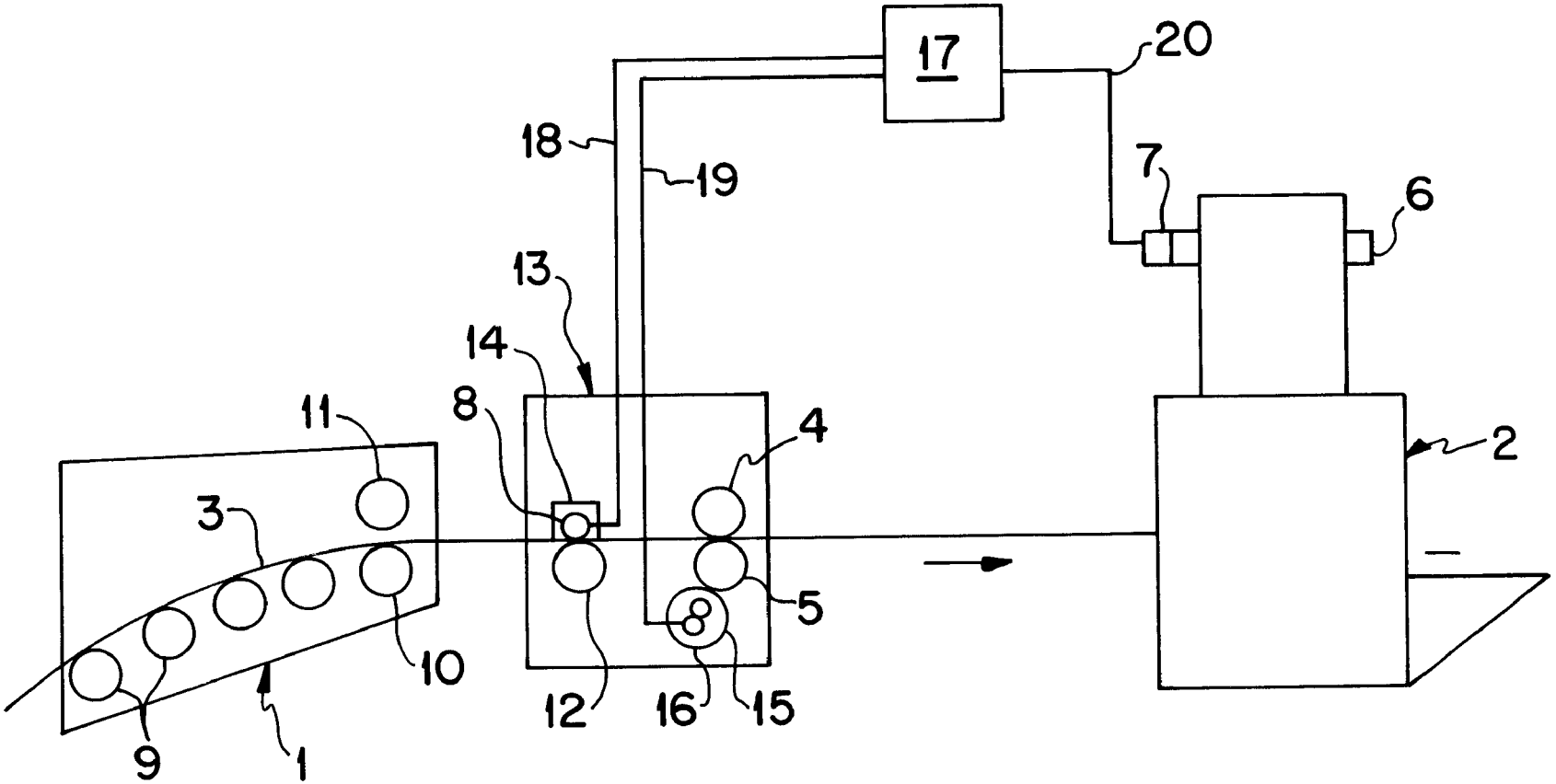
2
6
7
20
17
19
18
4
5
15
16
13
14
8
12
10
11
1
3
9

METHOD AND DEVICE FOR FEEDING OF LONG OBJECTS

This is a International Appln. No. PCT/SE99/01540 filed Sep. 3, 1999 which designated the U.S., and that International Application was published under PCT Article 21(2) in English.

BACKGROUND OF THE INVENTION

1. Field of the Invention

The present invention relates to a method and apparatus for feeding of strip or band material to working machines in which the material is worked upon and split up in individual parts. In particular, the invention is for feeding of metal bands to presses for bending, punching and cutting.

2. Description of Related Art

Feeding of material is preferably by a roll feeder at which the material is brought forward by two rolls between which the material is clamped. The rolls operate intermittently so that feeding of material takes place only when the working machine is in a position for receiving the material. Controllable parameters are stops and starts, rate of feeding and length of feeding.

The roll feeders are usually connected to a working machine, for example an eccentric press, hydraulic press or the like. These are often automated and continuously working machines as it is a requirement that the feed in fully agrees with the speed of operation and need for material of the working machine at each individual moment of operation, the feed in has to be synchronised with the working machine. The roll feeder should not feed material at a higher speed than the process requires as unnecessarily high speed brings with it raised standards of the included components and a greater wear than the correctly adjusted speed. If optimal synchronised operation shall be possible then the roll feeder shall feed the material slowly when the working machine runs slowly and when it works fast the roll feeder shall feed fast. Roll feeders which are under forced control by a mechanical connection with the working machine, for example the eccentric shaft of a press, follow the speed of the working machine but there are great difficulties at the setting of the feed length at a continuous or long material.

SUMMARY OF THE INVENTION

One aspect of the present invention is a method and apparatus at which the feed rate of a material feeding device, for example a roll feeder, automatically adjusts itself relative to the speed of the working machine.

The invention will below be described more in detail with reference to the enclosed figure.

DETAILED DESCRIPTION OF THE DRAWINGS

The FIGURE shows a roll feeder and an eccentric press to which material is fed by the roll feeder. The FIGURE is intended to show the principles of the invention, side walls and other details of the construction are not shown in the FIGURE.

DETAILED DESCRIPTION OF EXEMPLARY EMBODIMENTS

Material 3 in the shape of a continuous trip is supplied to the roll feeder 13 from a storage, a roll or the like. Over the support rolls 9, 10, 11, which are arranged in a bowshape within the supporting lane 1, the material 3 is fed in between the feed rolls 4 and 5 and further on to an eccentric press 2. The distance between the roll feeder 13 and the eccentric press is often much smaller than as shown in the figure. The upper feed roll 4 is forced downwards by a pneumatic cylinder or in any other suitable way. The feed rolls 4, 5 are driven by a motor 15 which works on the lower feed roll 5, the upper feed roll 4 is driven by the lower feed roll 5 by gear wheels. A measuring wheel 8 having a first pulse transmitter 14 is arranged adjacent to the feed rolls 4, 5 and in known manner it produces pulse signals 18 relative to the length and speed of the feeding of material 3. The measuring wheel 8 is forced downwards against the material 3 which underneath is supported by a lower support wheel or roll 12. Preferably the measuring wheel 8 is arranged ahead of the feed rools 4, 5 in the direction of conveyance of the material 3. As an alternative, a pulse transmitter 16 may be arranged so that pulse signals 19 are received directly from the driving motor 15. A second pulse transmitter 7 is arranged so that it delivers pulse signals 20 relative to the rotation of the eccentric shaft 6. The pulse signals 18, 19, 20 from the pulse transmitters 14, 16, 7 are input into a control system 17 with a processor in which the pulse signals 18, 19, 20 are processed. The pulse signals 20 from the second pulse transmitter 7 are then not only used to determine the position of the eccentric shaft 6 but also to determine its speed of rotation. The first pulse transmitter 14 may give pulse signals 18 which correspond to the speed of the material 3 and the length of fed material 3 during a cycle of operation. Various functions which are controlled by the control system 17 are when feed of material 3 is to be started and when it must be concluded and also various monitoring functions, for example that a part of the materials 3 which has been worked upon is removed from the eccentric press 2.

In addition to the functions which have been mentioned above, the method of the invention also comprises adapting the speed of the feeding of material 3 to the speed of rotation of the eccentric shaft 6 which may be achieved thereby that the number of pulse signals 20 per unit time from the second pulse transmitter 7 of the control system 17 is compared to the set length of feeding for each cycle of operation. The processor of the control system 17 then calculates the optimum speed of the feed rolls 4, 5. Preferably there have been input to the control system 17 limiting values for the feed rate and possibly also other variables. If these limit values are passed, various activities may be initiated by the control system 17, for example alarm, stop and error message to a display which is connected to the control system 17 or to a text message monitor.

The invention is above described with reference to an eccentric press 2 but it is not limited to this kind of working machine. Other machines with which the invention may find uses are other kinds of presses, punching and cutting machines, bending machines and the like. Besides the above described pulse transmitters other transmitters of the same or other kinds may be connected to the control system and these may affect, for example, the allowed limiting values.

What is claimed is:

1. A method of intermittently feeding strip material to a machine that processes the strip material by at least one of pressing, punching, cutting and bending, the method comprising:

generating first pulse signals indicative of a feed rate of the strip material;

generating second pulse signals indicative of a processing rate of the machine; and controlling the feed rate of the strip material to equal the processing rate of the machine.

2. The method of claim 1, wherein the first pulse signals are also indicative of a feed amount of the strip material and the second pulse signals are indicative of a feed amount for each cycle of operation of the machine, the method further comprising:

comparing the number of second pulse signals per unit time to a set feed amount for each cycle of operation; and controlling the feed rate of the strip material so that the feed amount equals the set feed amount.

3. The method of claim 1, wherein the strip material is fed by a pair of feed rolls and at least one of the feed rolls is driven by a motor.

4. The method of claim 3, wherein the first pulse signals are generated by a pulse transmitter operatively connected to the motor.

5. The method of claim 1, wherein the first pulse signals are generated by a pulse transmitter operatively connected to a measuring wheel in contact with the strip material.

6. The method of claim 5, wherein the measuring wheel is positioned ahead of a pair of feed rolls in a direction of conveyance of the strip material.

7. The method of claim 1, wherein the second pulse signals are generated by a pulse transmitter operatively connected to a shaft of the machine.

8. The method of claim 7, wherein the shaft is an eccentric shaft and the machine is an eccentric press.

9. The method of claim 1, further comprising:

setting a limiting value of the feed rate; and at least one of generating an alarm, stopping the feed of the strip material, and displaying an error message if the feed rate exceeds the limiting value.

10. An apparatus, comprising:

a roll feeder that intermittently feeds the strip material;

a machine that processes the strip material fed by the feed roller by at least one of pressing, punching, cutting and bending;

a first pulse transmitter that generates first pulse signals indicative of a feed rate of the strip material;

a second pulse transmitter that generates second pulse signals indicative of a processing rate of the machine; and a controller that receives the first and second pulse signals and controls the feed rate of the strip material to equal the processing rate of the machine.

11. The apparatus of claim 10, wherein the first pulse signals are indicative of a feed amount of the strip material and the second pulse signals are indicative of a feed amount for each cycle of operation of the machine and the controller compares the number of second pulse signals per unit time to a set feed amount for each cycle of operation and controls the feed rate of the strip material so that the feed amount equals the set feed amount.

12. The apparatus of claim 10, wherein the roll feeder includes a pair of feed rolls and at least one of the feed rolls is driven by a motor.

13. The apparatus of claim 12, wherein the first pulse transmitter is operatively connected to the motor.

14. The apparatus of claim 10, wherein the first pulse transmitter is operatively connected to a measuring wheel in contact with the strip material.

15. The apparatus of claim 14, wherein the measuring wheel is positioned ahead of a pair of feed rolls in a direction of conveyance of the strip material.

16. The apparatus of claim 10, wherein the second pulse transmitter is operatively connected to a shaft of the machine.

17. The apparatus of claim 16, wherein the shaft is an eccentric shaft and the machine is an eccentric press.

18. The apparatus of claim 10, wherein the controller includes an input limiting value of the feed rate and at least one of initiates an alarm, initiates an error message, and stops the roll feeder if the feed rate exceeds the limiting value.

* * * * *